US010920461B2

(12) United States Patent
Cunningham

(10) Patent No.: US 10,920,461 B2
(45) Date of Patent: Feb. 16, 2021

(54) VEHICLE DOOR LATCH ASSEMBLIES

(71) Applicant: Toyota Motor Engineering & Manufacturing North America, Inc., Erlanger, KY (US)

(72) Inventor: James D. Cunningham, Clarkston, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 567 days.

(21) Appl. No.: 15/829,321

(22) Filed: Dec. 1, 2017

(65) Prior Publication Data

US 2019/0169883 A1 Jun. 6, 2019

(51) Int. Cl.
*E05B 77/06* (2014.01)
*E05B 77/04* (2014.01)
*E05B 85/12* (2014.01)

(52) U.S. Cl.
CPC ..... *E05B 77/06* (2013.01); *E05B 77/04* (2013.01); *E05B 85/12* (2013.01); *Y10S 292/22* (2013.01)

(58) Field of Classification Search
CPC ..... E05B 77/04; E05B 77/06; E05B 85/12; E05B 85/14; E05B 85/16; E05B 85/18; Y10S 292/22
USPC ..... 292/336.3
See application file for complete search history.

(56) References Cited

U.S. PATENT DOCUMENTS 1,653,553 A * 12/1927 Edelmann ..... B60J 1/2097 292/175
2,203,333 A * 6/1940 Klumpp ..... E05C 17/04 292/67
4,083,264 A * 4/1978 Van Klompenburg .. G05G 1/12 16/441
4,639,040 A * 1/1987 Fujita ..... B60N 2/366 296/68.1
4,898,415 A * 2/1990 Satoh ..... E05B 79/06 292/337
5,499,851 A * 3/1996 Mitchell ..... E05B 79/06 292/337
5,961,165 A * 10/1999 Aizawa ..... E05B 85/18 292/336.3
6,240,754 B1 * 6/2001 Petersen ..... E05B 83/36 292/346

(Continued)

FOREIGN PATENT DOCUMENTS

JP 4643289 B2 3/2011
KR 100461173 B1 12/2004
KR 100836121 B1 6/2008

*Primary Examiner* — Carlos Lugo
(74) *Attorney, Agent, or Firm* — Dinsmore & Shohl LI.P

(57) ABSTRACT

A door latch assembly includes a handle bezel, a rotatable handle coupled to the handle bezel, and a bezel cap. The handle bezel includes a main body portion and a rib extending from the main body portion. The rotatable handle includes a handle lever extending through the main body portion of the handle bezel, wherein the handle lever extends alongside the rib of the handle bezel. The bezel cap is positioned in a first position at an end of the rib so as to provide clearance for the handle lever of the rotatable handle to rotate thereby. The bezel cap is configured to move along the rib toward the main body portion of the handle bezel to interfere with a rotation of the handle lever during a side impact condition.

20 Claims, 9 Drawing Sheets

(56) References Cited

U.S. PATENT DOCUMENTS

| | | | | |
|---|---|---|---|---|
| 6,367,124 | B1 * | 4/2002 | Bella | E05B 17/0041 16/438 |
| 6,523,869 | B1 * | 2/2003 | Jensen | E05B 83/16 292/216 |
| 6,565,134 | B1 * | 5/2003 | Stuart | E05B 77/06 292/336.3 |
| 6,575,508 | B2 * | 6/2003 | Stuart | E05B 77/06 292/336.3 |
| 6,616,202 | B2 * | 9/2003 | Choi | E05B 85/12 292/336.3 |
| 7,341,291 | B2 * | 3/2008 | Ooe | E05B 77/06 292/336.3 |
| 7,905,525 | B2 * | 3/2011 | Badia | E05B 17/007 16/82 |
| 8,167,342 | B2 * | 5/2012 | Bertolotti | E05B 77/06 292/336.3 |
| 8,491,020 | B2 * | 7/2013 | Lopes | B60D 1/60 292/1 |
| 8,727,402 | B2 * | 5/2014 | Bejune | E05B 77/04 292/336.3 |
| 8,894,108 | B2 * | 11/2014 | Corwin | E05B 77/06 292/336.3 |
| 9,528,301 | B2 | 12/2016 | Bendel et al. | |
| 9,617,759 | B2 | 4/2017 | Kang et al. | |
| 2017/0096843 | A1 | 4/2017 | Seo et al. | |

* cited by examiner

VEHICLE DOOR LATCH ASSEMBLIES

TECHNICAL FIELD

The present specification generally relates to door latch assemblies for vehicles and, more specifically, vehicle door latch assemblies for inhibiting rotation of a vehicle door handle from a latched configuration to an unlatched configuration.

BACKGROUND

During a side impact a side door lock may be unintentionally disengaged. For example, a side impact can cause an inner door handle to rotate based on contact of deforming vehicle components. This could cause unintended unlatching of the side door.

Accordingly, a need exists for alternative vehicle door latch assemblies for inhibiting rotation of a vehicle door handle from a latched configuration to an unlatched configuration.

SUMMARY

In one embodiment, a door latch assembly includes a handle bezel, a rotatable handle coupled to the handle bezel, and a bezel cap. The handle bezel includes a main body portion and a rib extending from the main body portion. The rotatable handle includes a handle lever extending through the main body portion of the handle bezel, wherein the handle lever extends alongside the rib of the handle bezel. The bezel cap is positioned in a first position at an end of the rib so as to provide clearance for the handle lever of the rotatable handle to rotate thereby. The bezel cap is configured to move along the rib toward the main body portion of the handle bezel to interfere with a rotation of the handle lever during a side impact condition.

In another embodiment, a vehicle includes a body and a door movably coupled to the body. The door includes an outer door panel and a door latch assembly position inboard of the outer door panel. The door latch assembly includes a handle bezel, a rotatable handle coupled to the handle bezel, and a bezel cap. The handle bezel includes a main body portion and a rib extending from the main body portion. The rotatable handle includes a handle lever extending through the main body portion of the handle bezel, wherein the handle lever extends alongside the rib of the handle bezel. The bezel cap is positioned in a first position at an end of the rib so as to provide clearance for the handle lever of the rotatable handle to rotate thereby. The bezel cap is configured to move along the rib toward the main body portion of the handle bezel to interfere with a rotation of the handle lever during a side impact condition.

In yet another embodiment, a method of inhibiting rotation of a door handle of a vehicle door from a latched configuration to an unlatched configuration includes connecting a bezel cap to a door latch assembly in a first position and moving the bezel cap from the first position to a second position. The door latch assembly includes a handle bezel and a rotatable handle. The handle bezel includes a main body portion and a rib extending from the main body portion, wherein the bezel cap is coupled to an end of the rib in the first position. The rotatable handle is coupled to the handle bezel and includes a handle lever extending through the main body portion of the handle bezel, wherein the handle lever extends alongside the rib of the handle bezel. The bezel cap provides clearance for the handle lever of the rotatable handle to rotate thereby when the bezel cap is in the first position. The bezel cap blocks rotation of the handle lever of the rotatable handle when the bezel cap is in the second position.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments described herein are directed to door latch assemblies that include structures to impede accidental opening of a vehicle side door in the event of a side impact condition. In particular, the figures generally illustrate a door latch assembly that includes a handle bezel, a rotatable handle coupled to the handle bezel, and a bezel cap. The handle bezel includes a main body portion and a rib extending from the main body portion. The rotatable handle includes a handle lever extending through the main body portion of the handle bezel, wherein the handle lever extends alongside the rib of the handle bezel. The bezel cap is positioned in a first position at an end of the rib and is configured to traverse a length of the rib to a second location, wherein the bezel cap can interfere with a rotation of the handle lever of the rotatable handle during a side impact condition. Such interference can prevent the rotatable handle from rotating, which can prevent the door latch assembly from unintentionally becoming unlatched and the door opening during a side impact. For example, the bezel cap is configured to slide along the rib toward the main body portion of the handle bezel to interfere with a rotation of the handle lever during a side impact condition. Various embodiments of the door latch assembly and its operation will be described in more detail herein.

Figure 1:
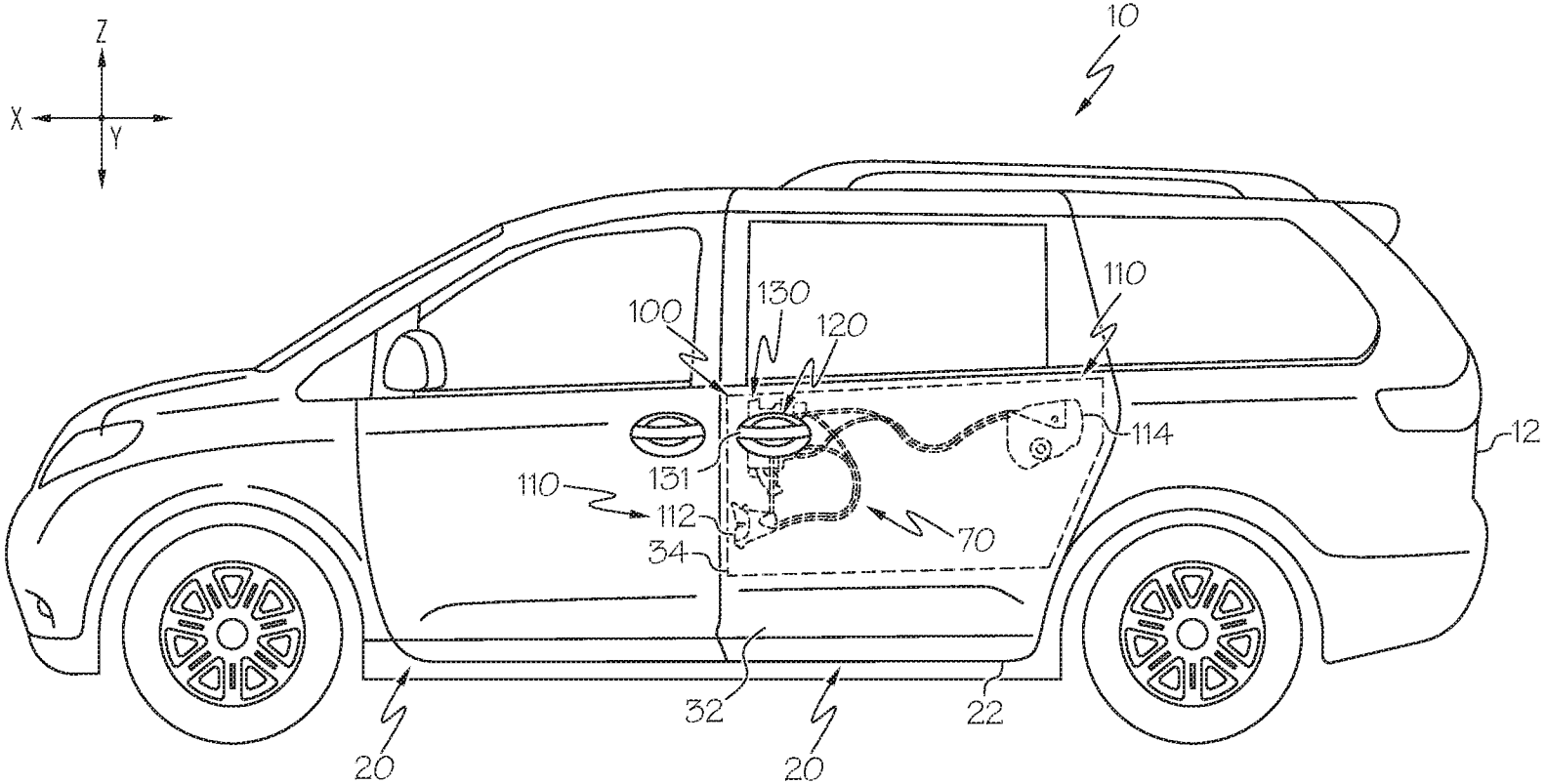
FIG. 1 depicts a vehicle, according to one or more embodiments shown and described herein.

Referring now to FIG. 1, a vehicle 10 according to the various embodiments is illustrated. As used herein, the term "vehicle longitudinal direction" refers to the forward-rearward direction of the vehicle 10 (i.e., in the +/− vehicle X-direction as depicted). The term "vehicle lateral direction" refers to the cross-vehicle direction (i.e., in the +/− vehicle Y-direction), and is transverse to the vehicle longitudinal direction. The term "vehicle vertical direction" refers to the upward-downward direction of the vehicle 10 (i.e., in the +/− vehicle Z-direction as depicted). Also use herein are the direction terms "outboard" and "inboard." Outboard refers to positions away from a center of the vehicle 10 in the vehicle lateral direction and inboard refers to positions toward the center of the vehicle 10 in the vehicle lateral direction.

Figure 2:
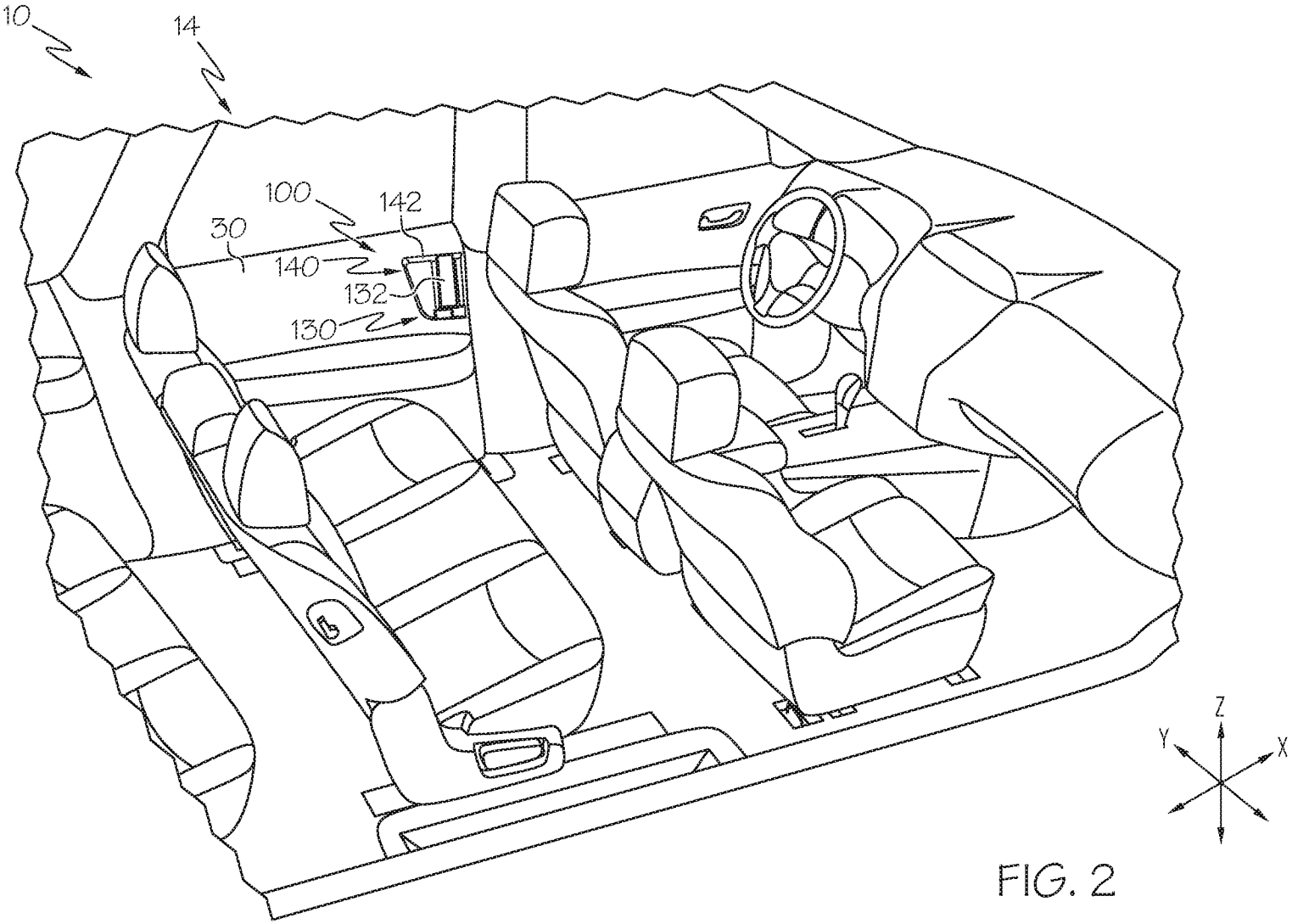
FIG. 2 depicts an interior of the vehicle of FIG. 1, according to one or more embodiments shown and described herein.

It is noted that while the vehicle 10 is depicted as a passenger van, the vehicle may be any passenger vehicle such as, for example, a terrestrial, aquatic, and/or airborne vehicle. The vehicle 10 includes a body 12 characterizing a frame of the vehicle 10. As shown in FIG. 2, the body 12 of the vehicle 10 defines an interior passenger compartment 14.

Referring collectively to FIGS. 1 and 2, the vehicle 10 includes a number of doors 20. The doors 20 serve as closure panels for an interior of the vehicle 10. Each door 20 is slidingly, pivotally or otherwise connected to the body 12 of the vehicle 10 such that the door 20 is capable of moving between a closed position and an open position. In particular, a rear passenger door 22 may be a slidingly connected to the body 12 of the vehicle 10, such as is found on many passenger vans. It is noted that while the remaining description will focus on latch assemblies 100 as part of a sliding rear passenger door 22, similar latch assemblies may be applicable to swinging or hingedly coupled passenger and driver doors.

The rear passenger door 22 is constructed from rigidly interconnected door frame members and door panels, as well as any combination of overlying paneling, trim, upholstery and other door coverings. The door panels include an upright inner door panel 30 (shown in FIG. 2) and an upright outer door panel 32 (shown in FIG. 1). In some embodiments, there may be additional outer and/or inner door panels. The inner door panel 30 and the outer door panel 32 are spaced apart from one another in the vehicle 10 lateral direction. As a result, the rear passenger door 22 has an interior door cavity 34 defined between the inner door panel 30 and the outer door panel 32.

The interior door cavity 34 can house various components of the rear passenger door 22. In particular, the interior door cavity 34 houses a portion of the door latch assembly 100 schematically illustrated by dashed lines in FIG. 1. The door latch assembly 100 operates to close, lock, unlock and open the rear passenger door 22. The door latch assembly 100 includes one or more latching mechanisms 110 operable to latch the rear passenger door 22 to the body 12 of the vehicle 10. Each of the one or more latching mechanisms 110 may be rigidly mounted within the interior door cavity 34.

In one embodiment, the door latch assembly 100 includes a front latching mechanism 112, positioned toward a front portion of the rear passenger door 22 in the vehicle longitudinal direction, and a rear latching mechanism 114, positioned toward a rear portion of the rear passenger door 22 in the vehicle longitudinal direction. For example, the front latching mechanism 112 may be positioned in a front lower quadrant of the rear passenger door 22 and the rear latching mechanism 114 may be positioned in a rear upper quadrant of the rear passenger door 22. However, it is contemplated that the front and rear latching mechanisms 112, 114 may be positioned anywhere within the rear passenger door 22. The front and rear latching mechanisms 112, 114 are operable to move a latch (not shown) from a latched position where it is coupled to the body 12 of the vehicle 10, wherein the rear passenger door 22 is unable to move relative to the body 12 of the vehicle 10, to an unlatched position, wherein the rear passenger door 22 is free to move relative to the body 12 of the vehicle 10.

Still referring to FIGS. 1 and 2, the door latch assembly 100 further includes an exterior handle assembly 120 and an interior handle assembly 130. Each handle assembly 120, 130 is rigidly mounted to the rear passenger door 22 as a unitary module. For example, the exterior handle assembly 120 is rigidly mounted to the exterior door panel 32 and the interior handle assembly 130 is rigidly mounted to the interior door panel 30. Each of the handle assemblies 120, 130 may be located at the upper-front quadrant of the rear passenger door 22. Each of the exterior handle assembly 120 and the interior handle assembly 130 have a rotatable handle 131, 132 operably coupled to the front and rear latching mechanisms 112, 114 so as to be able to disengage the front and rear latching mechanisms 112, 114.

For example, a linking system 70, including one or more linking elements (e.g., levers, rods, cables, and the like), is mounted within the door cavity 34 and couples the door handle assemblies 120, 130 to the one or more latching mechanisms 110 so as to allow operation of the one or more latching mechanisms 110 by the rotatable handle 131, 132. For example, by rotating a rotatable handle 131, 132 to an open position, the linking system 70 actuates the latches of the one or more latching mechanisms 110 such that the rear passenger door 22 can be opened.

Referring specifically to the interior handle assembly 130 of FIG. 2, the interior handle assembly 130 includes a handle bezel 140 by which the interior handle assembly 130 is rigidly mounted to the rear passenger door 22 and which houses and supports movement of the rotatable handle 132. The handle bezel 140 may extend from the interior panel 30 into the interior cavity 34, such that the rotatable handle 132 is at least partially sunken within the rear passenger door 22. The handle bezel 140 may be made of any suitable material and produced by any conventional forming techniques (e.g., injection molded plastic). It is noted that, though the handle bezel 140 is illustrated as having a particular shape, the handle bezel 140 can be any shape that is operable to house at least a portion of the rotatable handle 132 and support movement of the rotatable handle 132 to open the rear passenger door 22. The handle bezel 140 may couple to the interior panel 30 of the rear passenger door 22 through any conventional coupling techniques including, fasteners, adhesives, interlocking components that "snap" together, and the like.

Figure 3:
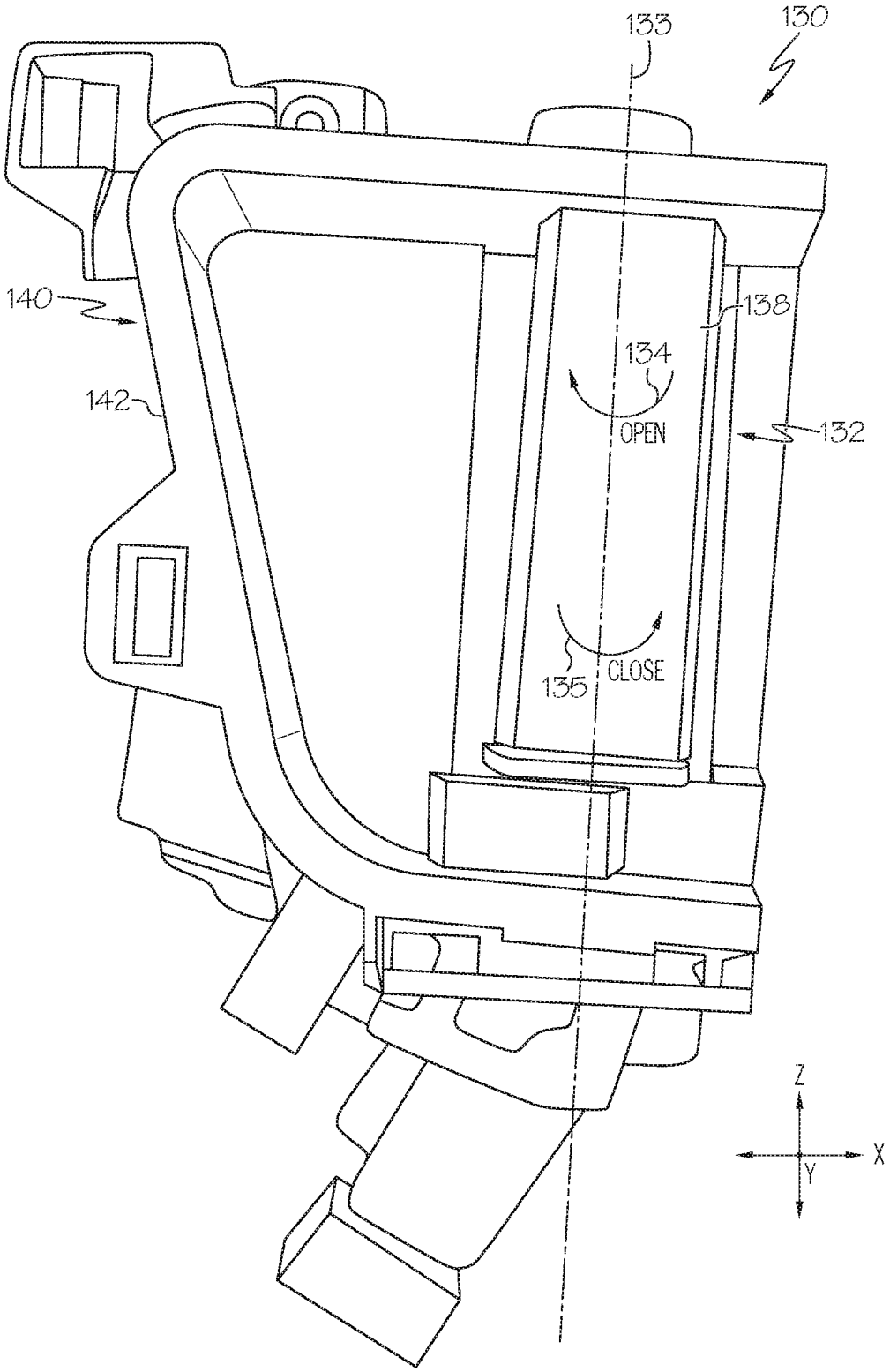
FIG. 3 depicts the interior facing side of a door latch assembly in isolation from the rest of the vehicle of FIG. 1, according to one or more embodiments shown and described herein.

FIG. 3 depicts the inboard facing side of the interior handle assembly 130 in isolation from the rest of the vehicle 10. The handle bezel 140 includes a main body portion 142 which houses the rotatable handle 132. The main body portion 142 of the handle bezel 140 of the interior handle assembly 130 supports the rotatable handle 132 for rotation or other movement relative to the rear passenger door 22 between a closed position, wherein the one or more latching mechanisms 110 are engaged, and an open position, wherein the one or more latching mechanisms 110 are disengaged and the rear passenger door 22 can be moved relative to the body 12 of the vehicle 10. For example, the rotatable handle 132 may be moved to the open position, by rotating the rotatable handle 132 about an axis 133 in an open direction 134. The interior handle assembly 130 also supports the rotatable handle 132 for automatic return movement from the open position to the closed position by rotating the rotatable handle 132 automatically back to its resting configuration in the closed direction 135. As one example, the rotatable handle 132 may be biased toward the closed position by a spring or other suitable biasing mechanism.

Figure 4:
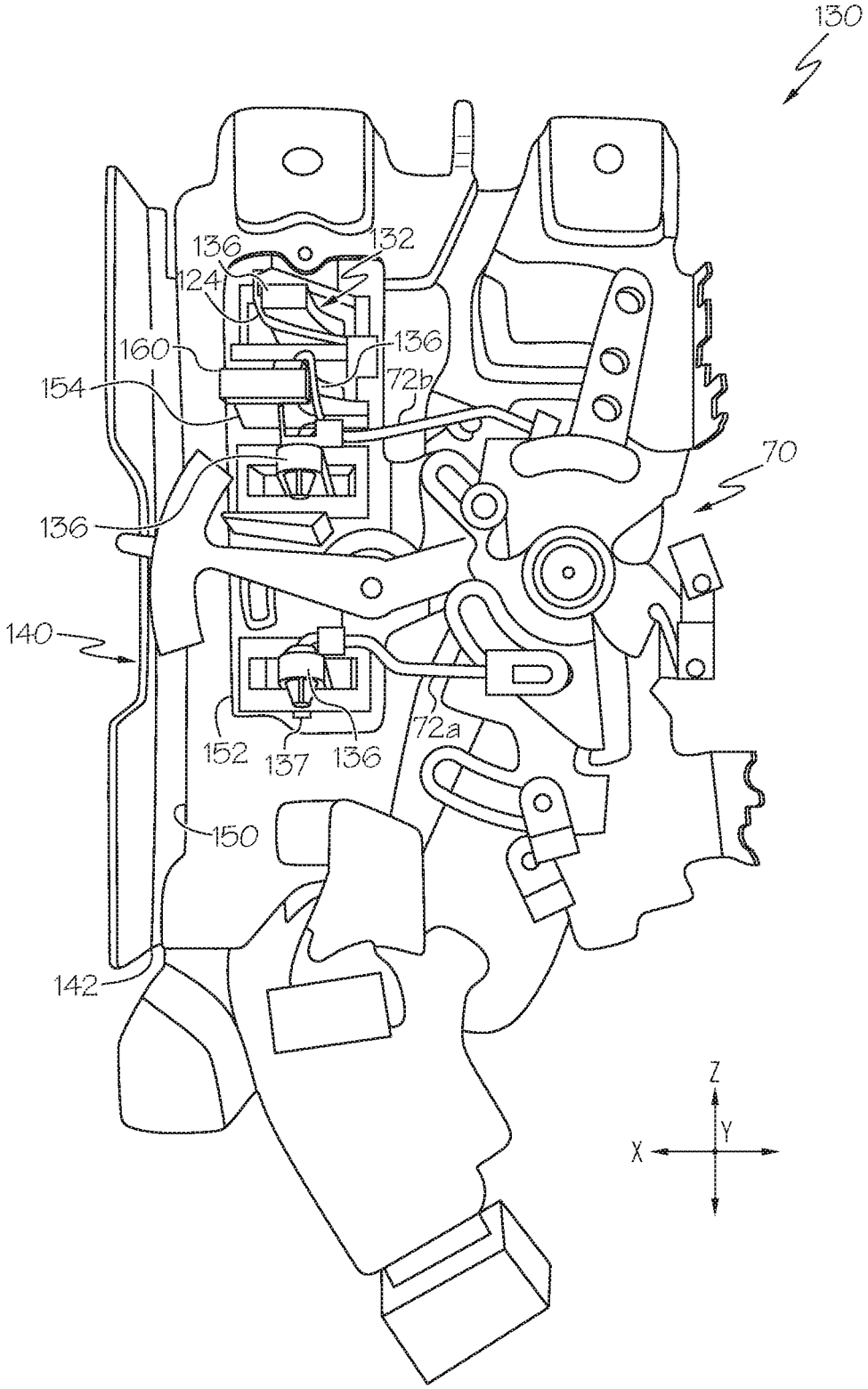
FIG. 4 depicts an exterior facing side of the door latch assembly of FIG. 2, according to one or more embodiments shown and described herein.

Referring now to FIG. 4, an outboard facing side of the interior handle assembly 130 in isolation from the rest of the vehicle 10 is depicted. From this perspective, it can be seen that the handle bezel 140 is coupled to a handle plate 150. The handle plate 150 provides a structural support for the rotatable handle 132, the handle bezel 140, and the various linking elements that allow the rear passenger door 22 to be opened and closed by rotating the rotatable handle 132 to the open position. The handle bezel 140 may be coupled to the base plate 150 through any conventional techniques including, but not limited to, the use of threaded fasteners. The base plate 150 includes an aperture 152 through which a portion of the handle bezel 140 and rotatable handle 132 extend. When assembled to the rear passenger door 22, the main body portion 142 of the handle bezel 140 (i.e., the part visible to from the interior 14 of the vehicle 10) is positioned inboard from the base plate 150, such that the rotatable handle 132 is accessible from within the vehicle 10, as shown in FIG. 3.

Figure 5A:
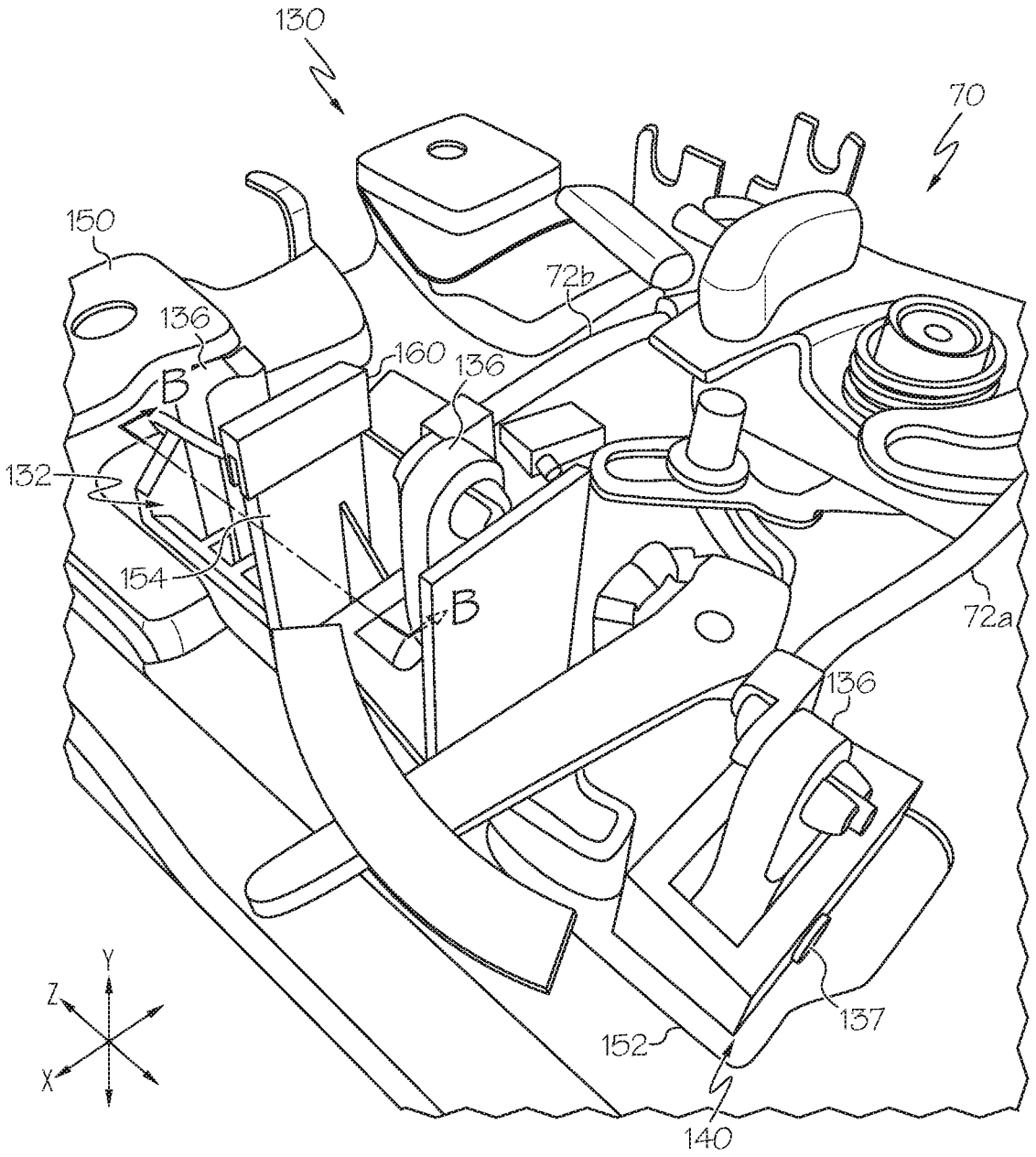
FIG. 5A depicts a perspective view of the exterior facing side of the door latch assembly of FIG. 3, according to one or more embodiments shown and described herein.
Figure 5B:
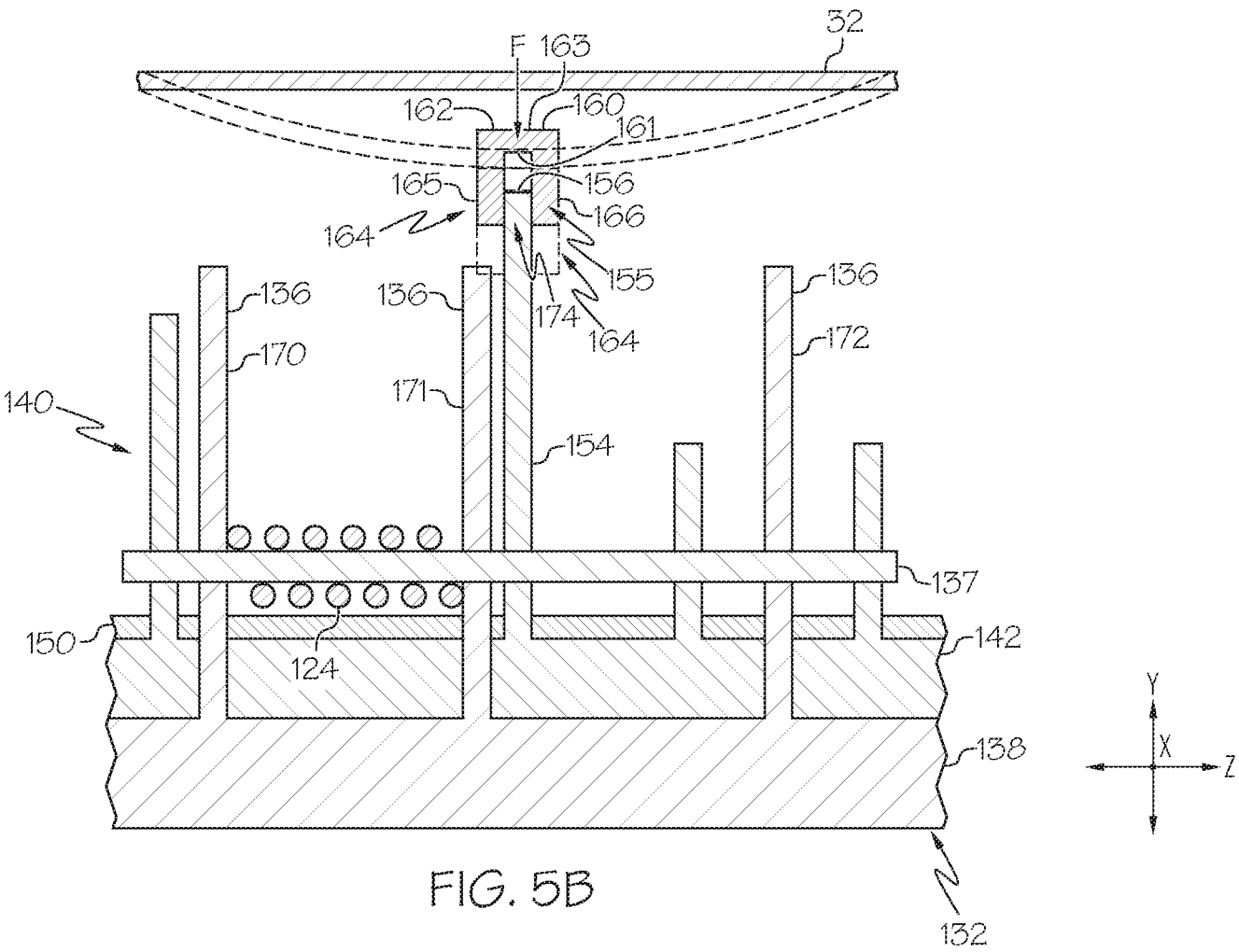
FIG. 5B depicts a schematic cross-section of the door latch assembly of FIG. 3, according to one or more embodiments shown and described herein.

Referring also to FIGS. 5A and 5B the handle bezel 140 includes a rib 154 that extend from the main body portion 142 through the aperture 152 of the base plate 150 in the outboard direction. The rib 154 may extend outwardly from the main body portion 142 in the vehicle lateral direction (y) and may be elongated. In some embodiments the rib 154 may have a width in the vehicle longitudinal direction (x) that is larger than a thickness in the vehicle vertical direction (z) providing a plate like shape. FIG. 5B illustrates simplified cross-section of the rib 154. It is contemplated that the rib 154 may have various cross-sections and are not limited to the rectangular cross-section shown. As will be described in more detail, a bezel cap 160 is positioned at an end 155 of the rib 154 and is configured to slide or otherwise move inboard during a vehicle side impact to block movement of the rotatable handle 132 by blocking rotation of a handle lever 136 of the rotatable handle 132, as will be described in greater detail below.

A portion of the rotatable handle 132 also extends through the aperture 152 of the base plate 150 alongside the rib 154 of the handle bezel 140. Specifically, the rotatable handle 132 includes one or more handle levers 136 that extend from a user handling portion 138 (shown in FIG. 4), through the handle bezel 140 and through the aperture 152 of the base plate 150. One of the handle levers 136 extend alongside the rib 154 of the handle bezel 140. A rod 137 extends through the one or more handle levers 136 and the handle bezel 140 to rotatably couple the rotatable handle 132 to the handle bezel 140. In some embodiments, the rod 137 extends through the rib 154 of the handle bezel 140. The rotatable handle 132 is able to rotate around the rod 137 by way of the one or more handle levers 136 that are rotably connected to the rod 137. A spring 124, such as shown in FIG. 5B, or other resistance element may be coupled to one of the one or more handle levers 136 and the bezel plate so as to provide resistance to rotation of the handle levers 136 and thus the rotation of the rotatable handle 132.

Referring again to FIG. 4, the linking system 70, which is only partially illustrated in FIG. 4, may be coupled to the one or more handle levers 136. For example, a link 72 may be coupled to at least one or more handle levers 136 at one end and to another portion of the linking system 70 at the other end, such as through a plurality of various linking members. The rotatable handle 132 is operable to unlock the one or more latching mechanisms 110, shown in FIG. 1 through the actuation of the links 72*a* and 72*b*. One of the handle levers 136 may be linked through the linking system 70 including the link 72*a* to the front latching mechanism 112 (FIG. 1) and another of the handle levers 136 may be linked through the linking system 70 including the link 72*b* to the rear latching mechanism 114 (FIG. 1) such that the front and rear latching mechanisms 112, 114 can be simultaneously unlocked by rotating the rotatable handle 132.

Located at the end 155 of the rib 154 is the bezel cap 160. The bezel cap 160 is configured to slide in an inboard direction along the rib 154 of the handle bezel 140 to interfere with rotation of an adjacent handle lever 136 during a side impact condition. FIG. 5B illustrates a simplified cross-section of the rib 154 of the handle bezel 140 and several handle levers 136 taken at line B-B in FIG. 5A. In the illustrated embodiment, the rotatable handle 132 includes a first handle lever 170, a second handle lever 171, and a third handle lever 172. The rib 154 of the handle bezel 140 may extend alongside any of the handle levers 136. In the particular embodiment the rib 154 is illustrated as extending alongside the second handle lever 171, also referred to as the adjacent handle lever 171. In particular, the rib 154 extends a distance farther than the adjacent handle lever 171 in the outboard direction. By extending outwardly beyond than the adjacent handle lever 171, the bezel cap 160 is able to be located at the end 155 of the rib 154 at a first position wherein the bezel cap 160 does not interfere with rotation of the adjacent handle lever 136.

The bezel cap 160 includes a back stop 162, having an impact receiving surface 163. When positioned in a first position, an interior surface 161 of the back stop 162 is spaced from a top surface 156 of the rib 154 providing a gap between the backstop 162 and the rib 154. Extending from the back stop 162 may be one or more sidewalls 164 configured to couple the bezel cap 160 to the rib 154. When positioned in the first position on the rib 154, at least one of the one or more sidewalls 164 of the bezel cap 160 ends at a position outboard of an end of the adjacent handle lever 171. For example, a sidewall 164 of the bezel cap 160 may be spaced from the end of the adjacent handle lever 171 in an outboard direction about 5 mm or less (e.g., 5 mm, 4 mm, 3 mm, and the like).

The bezel cap 160 may be configured to match a cross-sectional shape of the rib 154 to which it is attached. For example, the rib 154 of the present embodiment comprises a substantially rectangular cross-section. Hence, the one or more sidewalls 164 of the bezel cap 160 of the present embodiment includes a first sidewall 165 positioned on one side of the rib 154 and a second sidewall 166 positioned on the opposite side of the rib 154. In other words, a distance between the sidewalls 164 may be greater than the thickness of the rib 154. The second sidewall 166 may be positioned parallel to the first sidewall 165 and spaced apart from the first sidewall 165 such that a bezel rib receiving channel 174 is defined therebetween.

In some embodiments, it is contemplated one or more sidewalls 164 of the bezel cap 160 may enclose the rib 154 on all sides or the bezel cap 160 may be open at either end 168, 169. By providing an opening at either end 168, 169 of the bezel cap 160, air may readily escape from the gap between the end 156 of the rib 154 and the back stop 162 of the bezel cap 160 as a distance between the back stop 162 and the end 156 of the rib 154 closes during a side impact condition and as will be described in greater detail herein. It is noted that the bezel cap 160 may be formed from any conventional material using any conventional forming technique. For example, the bezel cap may be an injection molded plastic, zinc die cast, stamped metal (e.g., aluminum, zinc, copper, tin, etc.), and the like.

Still referring to FIG. 5B, during a side impact, the outer door panel 32 may deform inward toward the inner handle assembly 120. It is noted that the outer door panel 32 need not be the outer most door panel, only a door panel positioned outboard of the bezel cap 160. As illustrated, the outer door panel 32 can deform inboard and contact the impact receiving surface 163 of the bezel cap 160 and cause the bezel cap 160 to move from the first position wherein the back stop 162 is spaced apart from the end 156 of the rib 154 to a second position wherein the back stop 162 is in contact with the end 156 of the rib 154 and one of the one or more sidewalls 164 is positioned in a path of rotation of the adjacent handle lever 136.

Figure 6:
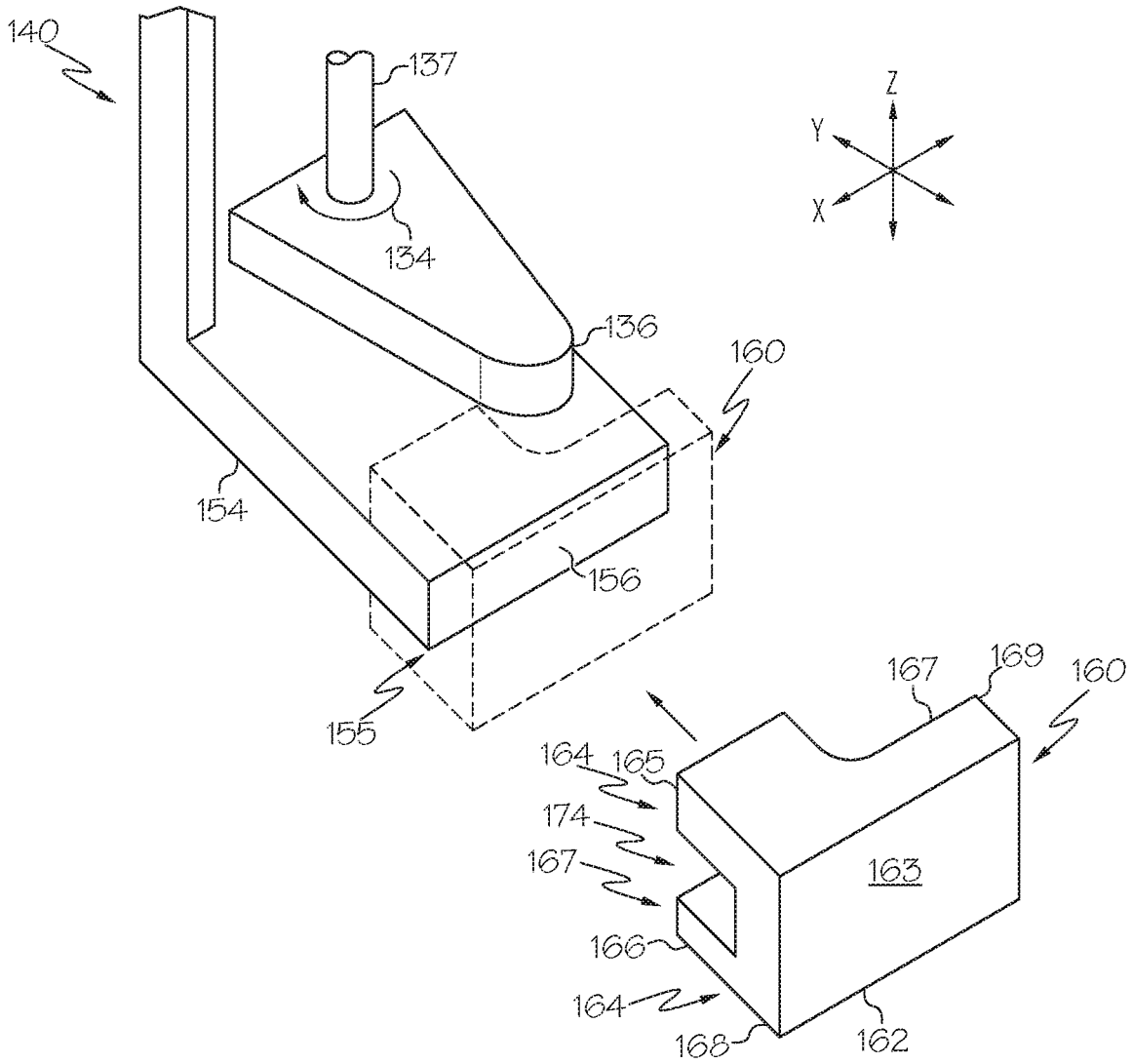
FIG. 6 illustrates a bezel cap positioned away from a rib of a handle bezel of a door latch assembly, according to one or more embodiments shown and described herein.

In some embodiments, one of the one or more sidewalls 164 may include a portion that is configured to extend past the lever of the rotatable handle in an inboard direction during a side impact condition. For example, FIG. 6 illustrates the bezel cap 160 positioned away from the rib 154. At least one of the one or more sidewalls 164 is illustrated as having a cutout 167 formed therein to accommodate the handle lever 136 when the bezel cap 160 is in the second position. In this way, when the bezel cap 160 moves into the second position during a side impact condition, shown by dashed lines, a portion of the sidewall 164 moves into the path of rotation of the handle lever 136 and blocks the handle lever 136 from rotating to the open position.

Figure 7A:
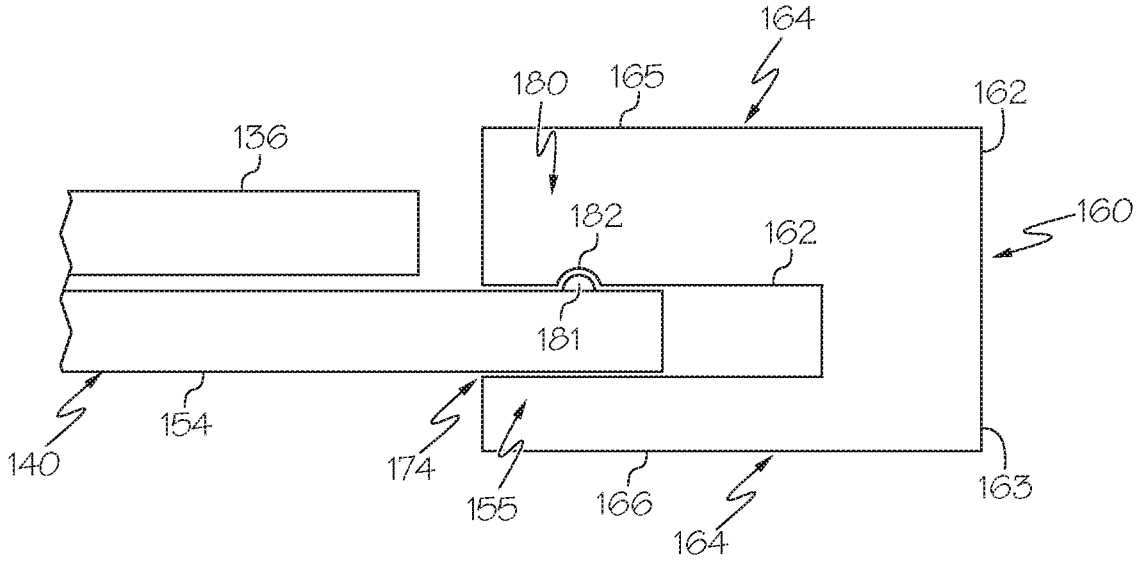
FIG. 7A illustrates a bezel cap positioned in a first position on a rib of a handle bezel of a door latch assembly, according to one or more embodiments shown and described herein.
Figure 7B:
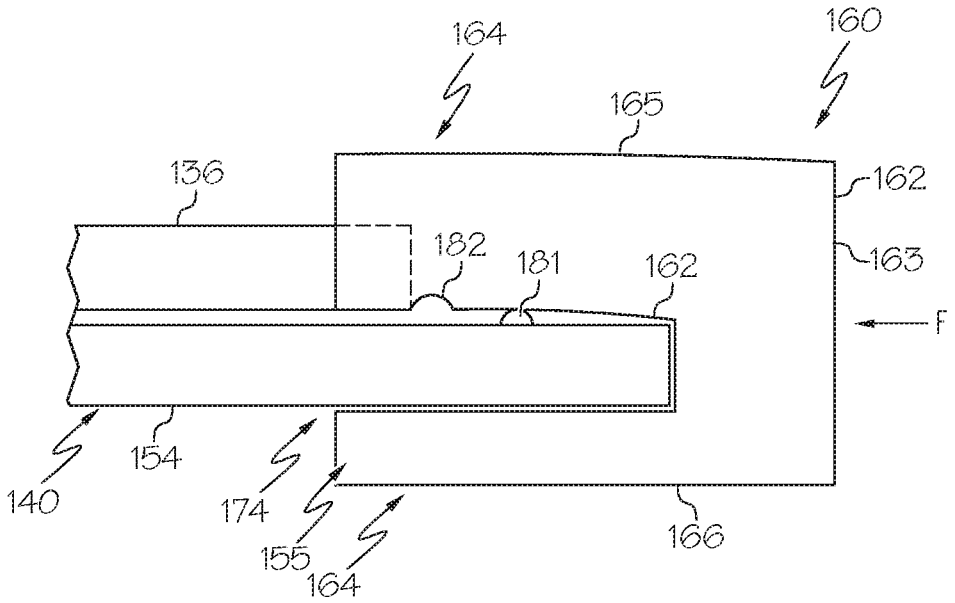
FIG. 7B illustrates the bezel cap of FIG. 7A positioned in a second position, wherein the bezel cap interferes with rotation of a level of a rotatable handle of the door latch assembly, according to one or more embodiments shown and described herein.

FIGS. 7A and 7B illustrate a coupling structure 180 to couple the bezel cap 160 to the rib 154 of the handle bezel 140 in the first position. For example, the rib 154 may include a first position coupling structure 181 (e.g., a bump) that protrudes from a surface of the rib 154. A sidewall 164 of the bezel cap 160 may include a receiving structure 182 (e.g., a mating cutout) configured to receive the first position coupling structure 181 of the bezel cap 160. Alternatively, the first position coupling structure 181 may be positioned on an interior surface of the sidewall 164 of the bezel cap 160 and the receiving structure 182 may be formed within the surface of the rib 154. In either case, the first position coupling structure 181 and the receiving structure 182 form an interlock that couples the bezel cap 160 to the rib 154 in the first position (i.e., where the back stop 162 is spaced from the end 156 of the rib 154). During normal operating conditions, the coupling structure 180 can prevent the bezel cap 160 unintentionally from sliding along the rib 154 of the handle bezel 140 to interfere with rotation of the rotatable handle 132. During a side impact, the force of the impact can overcome the interlock between the bezel cap 160 and the rib 154 to push the bezel cap 160 further along the rib 154 to the second position so that the sidewall 164 of the bezel cap 160 blocks rotation of the adjacent handle lever 136.

Figure 8:
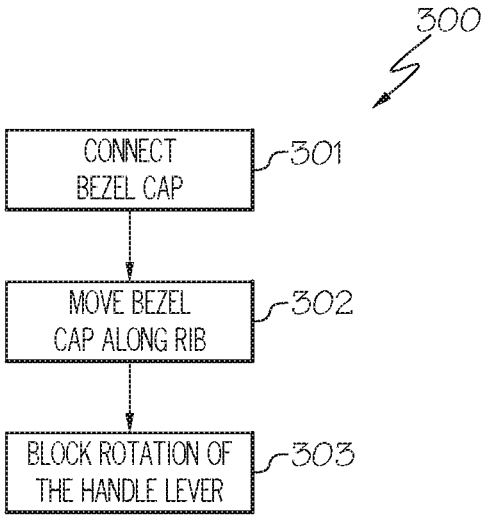
FIG. 8 illustrates a method of inhibiting rotation of the rotatable handle of a vehicle door from a latched configuration to an unlatched configuration using the bezel cap as described herein.

FIG. 8 illustrates a method 300 of inhibiting rotation of the rotatable handle 132 of a vehicle 10 door 20 from a latched configuration to an unlatched configuration using the bezel cap 160 as described herein. The first step 301 includes connecting a bezel cap 160 to a rib 154 of the handle bezel 140 in a first position. As described herein, in the first position the back stop 162 of the bezel cap 160 is spaced apart from the end 156 of the rib 154. The second step 302 includes moving the bezel cap 160 along a length of the rib 154 from the first position to a second position, wherein the bezel cap 160 blocks rotation of the handle lever 136 of the rotatable handle 132 (step 303). As noted herein contact between the outer door panel 32 or another panel positioned outboard of the rib 154 of the handle bezel 140 and the bezel cap 160 causes the bezel cap 160 to move along the length of the rib 154 of the handle bezel 140.

It should now be understood that embodiments of the present disclosure are directed to door latch assemblies that include a handle bezel having a rib. Coupled to the rib is an end cap configured to slide in an inboard direction along the rib to block a handle lever of a rotatable handle. By blocking rotation of the rotatable lever, the door can be prevented from unintentionally opening during a side impact condition.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A door latch assembly comprising:

a handle bezel comprising a main body portion and a rib extending from the main body portion;

a rotatable handle configured to be operatively coupled to a door latch, the rotatable handle coupled to the handle bezel and comprising a handle lever extending through the main body portion of the handle bezel, wherein the handle lever extends alongside the rib of the handle bezel; and a bezel cap defining a bezel rib receiving channel, wherein the bezel cap is positioned in a first position at an end of the rib so as to provide clearance for the handle lever of the rotatable handle to rotate thereby, wherein the bezel cap via the bezel rib receiving channel is configured to move along the rib toward the main body portion of the handle bezel to interfere with a rotation of the handle lever during a side impact condition, wherein a force of the side impact condition is transferred to the bezel cap.

2. The door latch assembly of claim 1, wherein the rib of the handle bezel extends outward a distance beyond the handle lever of the rotatable handle.

3. The door latch assembly of claim 1, wherein the bezel cap comprises one or more sidewalls, wherein a portion of the one or more sidewalls is configured to extend into a path of the handle lever of the rotatable handle during the side impact condition.

4. The door latch assembly of claim 1, wherein the bezel cap comprises one or more sidewalls comprising a first position coupling structure and the rib comprises a receiving structure so as to couple the bezel cap to the rib of the handle bezel in the first position.

5. The door latch assembly of claim 1, wherein the bezel cap comprises:

a first sidewall;

a second sidewall positioned parallel to the first sidewall, the first and second sidewalls defining the bezel rib receiving channel therebetween; and a back stop coupled to each the first and second sidewalls.

6. The door latch assembly of claim 5, wherein:

at least one of the first sidewall and the second sidewall comprises a first position coupling structure; and the rib comprises a receiving structure so as to couple the bezel cap to the rib of the handle bezel in the first position.

7. A vehicle comprising:

a body; and a door movably coupled to the body, wherein the door comprises:

an outer door panel; and a door latch assembly positioned inboard of the outer door panel and comprising:

a handle bezel comprising a main body portion and a rib extending from the main body portion;

a rotatable handle configured to be operatively coupled to a door latch, the rotatable handle coupled to the handle bezel and comprising a handle lever extending through the main body portion of the handle bezel, wherein the handle lever extends alongside the rib of the handle bezel; and a bezel cap defining a bezel rib receiving channel, wherein the bezel cap is positioned in a first position at an end of the rib so as to provide clearance for the handle lever of the rotatable handle to rotate thereby, wherein the bezel cap via the bezel rib receiving channel is configured to move along the rib toward the main body portion of the handle bezel to interfere with a rotation of the handle lever during a side impact condition, wherein a force of the side impact condition is transferred to the bezel cap.

8. The vehicle of claim 7, wherein contact between the outer door panel and the bezel cap during the side impact condition causes the bezel cap to slide from the first position to a second position where the bezel cap blocks the rotation of the handle lever.

9. The vehicle of claim 7, wherein the rib of the handle bezel extends outward a distance beyond the handle lever of the rotatable handle.

10. The vehicle of claim 7, wherein the bezel cap comprises a sidewall, wherein a portion of the sidewall is configured to extend into a path of the handle lever of the rotatable handle during the side impact condition.

11. The vehicle of claim 7, wherein the bezel cap comprises one or more sidewalls comprising a first position coupling structure and the rib comprises a receiving structure so as to couple the bezel cap to the rib of the handle bezel in the first position.

12. The vehicle of claim 7, wherein the bezel cap comprises:

a first sidewall;

a second sidewall positioned parallel to the first sidewall, the first and second sidewalls defining the bezel rib receiving channel therebetween; and a back stop coupled to each the first and second sidewalls.

13. The vehicle of claim 12, wherein:

at least one of the first sidewall and the second sidewall comprises a first position coupling structure; and the rib comprises a receiving structure so as to couple the bezel cap to the rib of the handle bezel in the first position.

14. A method of inhibiting rotation of a door handle of a vehicle door from a latched configuration to an unlatched configuration, the method comprising:

providing a handle bezel comprising a main body portion and a rib extending from the main body portion;

coupling a rotatable handle comprising a handle lever to the handle bezel such that the handle lever extends through the main body portion of the handle bezel and alongside the rib of the handle bezel;

positioning a bezel cap defining a bezel rib receiving channel in a first position at an end of the rib so as to provide clearance for the handle lever of the rotatable handle to rotate thereby, wherein the bezel cap via the bezel rib receiving channel is configured to move to a second position along the rib toward the main body portion of the handle bezel to interfere with a rotation of the handle lever during a side impact condition, wherein a force of the side impact condition is transferred to the bezel cap.

15. The method of claim 14 further comprising contacting the bezel cap with an outer door panel of the vehicle door, wherein contact between the bezel cap and the outer door panel causes the bezel cap to move along the length of the rib of the handle bezel.

16. The method of claim 14, wherein the rib of the handle bezel extends outward a distance beyond the handle lever of the rotatable handle.

17. The method of claim 14, wherein the bezel cap comprises a sidewall, wherein a portion of the sidewall is configured to extend into a path of the handle lever of the rotatable handle when in the second position.

18. The method of claim 14, wherein the bezel cap comprises one or more sidewalls comprising a first position coupling structure and the rib comprises a receiving structure so as to couple the bezel cap to the rib of the handle bezel in the first position.

19. The method of claim 14, wherein the bezel cap comprises:

a first sidewall;

a second sidewall positioned parallel to the first sidewall, the first and second sidewalls defining the bezel rib receiving channel therebetween; and a back stop coupled to each the first and second sidewalls.

20. The method of claim 19, wherein:

at least one of the first sidewall and the second sidewall comprises a first position coupling structure; and the rib comprises a receiving structure so as to couple the bezel cap to the rib of the handle bezel in the first position.

* * * * *